US011240608B2

(12) United States Patent
Bisgaard et al.

(10) Patent No.: US 11,240,608 B2
(45) Date of Patent: Feb. 1, 2022

(54) DEVICE FOR PROVIDING A HEARING AID USER GUIDE AND RELATED METHOD

(71) Applicant: GN Hearing A/S, Ballerup (DK)

(72) Inventors: Nikolai Bisgaard, Kgs. Lyngby (DK); Camilla Just Holm, Birkeroed (DK); Steve Hallenbeck, Claredon Hills, IL (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/478,274

(22) Filed: Sep. 5, 2014

(65) Prior Publication Data

US 2016/0066100 A1 Mar. 3, 2016

(30) Foreign Application Priority Data

Aug. 29, 2014 (DK) ..... PA 2014 70525
Aug. 29, 2014 (EP) ..... 14182944

(51) Int. Cl.
*H04R 25/00* (2006.01)

(52) U.S. Cl.
CPC ..... *H04R 25/30* (2013.01); *H04R 2225/55* (2013.01)

(58) Field of Classification Search
CPC ..... H04R 25/30; H04R 25/558; H04R 25/70; H04R 25/305; H04R 25/00; H02J 7/025
See application file for complete search history.

(56) References Cited

U.S. PATENT DOCUMENTS 4,992,966 A * 2/1991 Widin ..... H04R 25/70 379/52
6,788,313 B1 * 9/2004 Heil ..... G06F 9/453 715/705
7,903,827 B1 * 3/2011 Lockwood ..... A61B 5/121 381/60
8,565,458 B2 * 10/2013 Eisenberg ..... H04R 25/00 381/315
9,084,065 B2 * 7/2015 Hasler ..... H04R 25/552
2002/0054689 A1 * 5/2002 Zhang ..... G06F 8/65 381/312
2007/0009123 A1 1/2007 Aschoff et al.
2007/0076909 A1 * 4/2007 Roeck ..... H04R 25/70 381/312

(Continued)

FOREIGN PATENT DOCUMENTS

CN 101695147 A 4/2010
CN 103916804 A 7/2014

(Continued)

OTHER PUBLICATIONS

Extended European Search Report dated Dec. 12, 2014, for corresponding EP Patent Application No. EP 14182944.0, 6 pages.

(Continued)

*Primary Examiner* — Angelica M McKinney
(74) *Attorney, Agent, or Firm* — Vista IP Law Group, LLP

(57) ABSTRACT

A method and a device for providing a hearing aid user guide is disclosed. The device comprises a communication interface and a processing unit connected to the communication interface. The processing unit is configured for: obtaining at least one hearing aid setting of a hearing aid via the communication interface; configuring a user guide based on the at least one hearing aid setting; and providing the user guide.

17 Claims, 8 Drawing Sheets

(56) References Cited

U.S. PATENT DOCUMENTS

| | | | | |
|---|---|---|---|---|
| 2007/0230711 | A1* | 10/2007 | Hasler | H04R 25/70 381/58 |
| 2007/0279653 | A1 | 12/2007 | Bonikowski | |
| 2009/0052711 | A1 | 2/2009 | Murozaki | |
| 2009/0074215 | A1* | 3/2009 | Schumaier | H04R 25/75 381/314 |
| 2009/0204242 | A1 | 8/2009 | Honda | |
| 2012/0140963 | A1* | 6/2012 | Larsen | H02J 7/025 381/315 |
| 2014/0211972 | A1* | 7/2014 | Kim | H04R 25/70 381/314 |
| 2014/0321682 | A1* | 10/2014 | Kofod-Hansen | H04R 25/305 381/315 |
| 2015/0078598 | A1* | 3/2015 | Yliaho | H04R 25/30 381/315 |
| 2015/0120389 | A1* | 4/2015 | Zhang | G06Q 10/10 705/7.32 |
| 2015/0227276 | A1* | 8/2015 | Batti | G06F 17/2247 715/235 |
| 2016/0066100 | A1* | 3/2016 | Bisgaard | H04R 25/30 381/314 |
| 2016/0360327 | A1* | 12/2016 | Ungstrup | H04R 25/505 |
| 2017/0208401 | A1* | 7/2017 | Johansen | H04R 25/558 |

FOREIGN PATENT DOCUMENTS

| | | | | |
|---|---|---|---|---|
| EP | 0537026 | A2 * | 4/1993 | H04R 25/558 |
| EP | 0537026 | A2 * | 4/1993 | H04R 25/558 |
| EP | 2 750 407 | A1 | 7/2014 | |
| JP | 2001-306585 | A | 11/2001 | |
| JP | 2003-006206 | A | 1/2003 | |
| JP | 2008-109307 | A | 5/2008 | |
| JP | 2011-101136 | A | 5/2011 | |
| JP | 2011101136 | A * | 5/2011 | |
| WO | WO 2007020301 | A2 * | 2/2007 | H04R 25/70 |
| WO | WO 2009/000311 | A1 | 12/2008 | |
| WO | WO-2009000311 | A1 * | 12/2008 | H04R 25/70 |
| WO | WO 2009000311 | A1 * | 12/2008 | H04R 25/558 |
| WO | WO 2011/018086 | A1 | 2/2011 | |
| WO | WO 2011018086 | A1 * | 2/2011 | H02J 7/025 |

OTHER PUBLICATIONS

First Technical Examination and Search Report dated Mar. 25, 2015, for corresponding Danish Patent Application No. PA 2014 70525, 5 pages.

Japanese Non-Final Office Action dated May 14, 2019 for corresponding Japanese Patent Application No. 2015-169385.

English Translation of Japanese Non-Final Office Action dated May 14, 2019 for corresponding Japanese Patent Application No. 2015-169385.

Office Action dated Oct. 9, 2019 for corresponding Japanese Application No. K150473JP.

Office Action dated Nov. 5, 2019 for corresponding Chinese Patent Application No. CN 201510541961.8.

Foreign Office Action dated Mar. 23, 2021 for EP Appln. No. 14182944.0.

* cited by examiner

DEVICE FOR PROVIDING A HEARING AID USER GUIDE AND RELATED METHOD

RELATED APPLICATION DATA

This application claims priority to and the benefit of European Patent Application No. 14182944.0 filed Aug. 29, 2014, pending, and Danish Patent Application No. PA 2014 70525 filed Aug. 29, 2014, pending. The entire disclosures of both of the above applications are expressly incorporated by reference herein.

FIELD

The present disclosure relates to a device, in particular a fitting device or a mobile terminal, for providing a hearing aid user guide, the device comprising a communication interface and a processing unit connected to the communication interface, and to a method for configuration of a hearing aid user guide

BACKGROUND

Hearing aids become increasingly advanced and complicated with regard to functionality and features which leads to large and cumbersome hearing aid user guides with superfluous information that may confuse a user or even lead to unintended use of the hearing device. Further, certain functionalities or features of a hearing aid may not be supported or enabled, and different hearing aids may have different functionality depending on the fitting thereof.

SUMMARY

There is a need for a device and method for improving hearing aid user guides.

Disclosed is a device for providing a hearing aid user guide, the device comprising a communication interface and a processing unit connected to the communication interface. The processing unit is configured for obtaining at least one hearing aid setting of a hearing aid via the communication interface; configuring a user guide based on the at least one hearing aid setting; and providing the user guide.

Also disclosed is a method for configuring a user guide for a hearing aid. The method comprises obtaining at least one hearing aid setting; configuring a user guide based on the at least one hearing aid setting; and providing the user guide.

It is an advantage of the present disclosure that a hearing aid user guide with optimum use of memory resources is provided. Further, an improved hearing aid user guide is provided by only containing the necessary information for a specific user of a hearing aid.

The present disclosure provides a hearing aid user guide tailored to a specific user and his hearing aid, which leads to an improved user experience since only the information relevant for the specific user is provided. There is also a need to optimize the amount of information in the user guide and the present disclosure provides for effective use of data transmission capacity. Further, the disclosed device and method reduces the number of user enquiries to customer service or hearing aid dispensers by providing an improved user guide with reduced or no unnecessary information.

A device for providing a hearing aid user guide includes: a communication interface; and a processing unit connected to the communication interface, wherein the processing unit is configured for: obtaining at least one hearing aid setting of a hearing aid via the communication interface; configuring a user guide based on the at least one hearing aid setting; and providing the user guide.

Optionally, the device is selected from the group consisting of a mobile terminal and a hearing aid fitting device.

Optionally, the communication interface comprises a network interface card, a WIFI transceiver, a Bluetooth transceiver, or a Bluetooth low energy transceiver.

Optionally, the device is a hearing aid fitting device, and wherein the processing unit is configured to provide the user guide by transmitting the user guide to a mobile terminal via the communication interface.

Optionally, the device is a mobile terminal, and wherein the processing unit is configured to provide the user guide by storing the user guide in a memory of the device.

Optionally, the device is a mobile terminal, the communication interface comprises a display, and the mobile terminal is configured for presenting the user guide on the display.

Optionally, the at least one hearing aid setting comprises a first hearing aid setting indicative of a hearing aid model.

Optionally, the processing unit is configured to include a picture of a first hearing aid in the user guide if the first hearing aid setting is indicative of a first hearing aid model, and to include a picture of a second hearing aid in the user guide if the first hearing aid setting is indicative of a second hearing aid model, to thereby configure the user guide.

Optionally, the at least one hearing aid setting comprises one or more mode indicators including a first mode indicator indicative of whether a first mode of the hearing aid is enabled or disabled.

Optionally, the processing unit is configured to include a user guide part for the first mode in the user guide if the first mode indicator indicates that the first mode is enabled, to thereby configure the user guide.

Optionally, the processing unit is configured to exclude a user guide part for the first mode from the user guide if the first mode indicator indicates that the first mode is disabled, to thereby configure the user guide.

Optionally, the at least one hearing aid setting comprises one or more accessory device indicators including a first accessory device indicator indicative of whether a first accessory device is enabled or disabled.

Optionally, the processing unit is configured to include a user guide part for the first accessory device in the user guide if the first accessory device indicator indicates that the first accessory device is enabled.

Optionally, the processing unit is configured to exclude a user guide part for the first accessory device from the user guide if the first accessory device indicator indicates that the first accessory device is disabled.

Optionally, the at least one hearing aid setting comprises a user interface indicator indicative of a functionality of a hearing aid user interface of the hearing aid.

Optionally, the processing unit is configured to include a first description of a first functionality in the user guide if the user interface indicator is indicative of a first functionality of the hearing aid user interface, and to include a second description of a second functionality in the user guide if the user interface indicator is indicative of a second functionality of the hearing aid user interface, to thereby configure the user guide.

Optionally, the at least one hearing aid setting comprises battery information, and wherein the processing unit is configured to configured the user guide based on the battery information.

A method for configuring a user guide for a hearing aid, includes: obtaining at least one hearing aid setting by a device via a communication interface; configuring a user guide by the device based on the at least one hearing aid setting; and providing the user guide.

Other and further aspects and features will be evident from reading the following detailed description of the embodiments.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
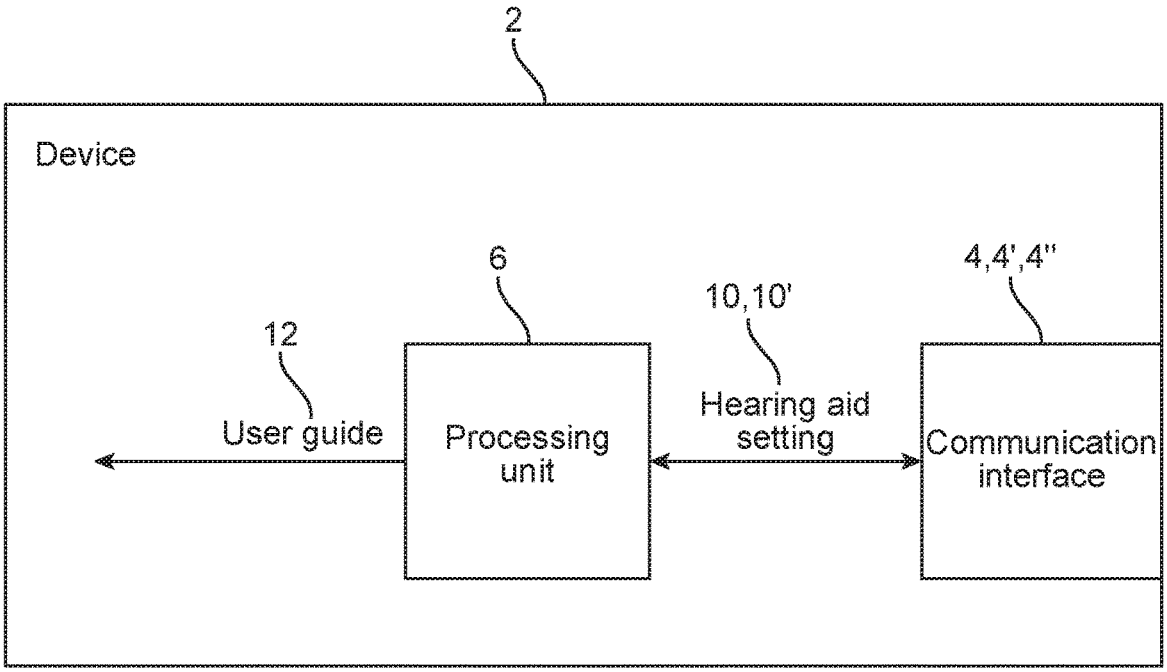
FIG. 1 schematically illustrates an exemplary device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

A device for providing a hearing aid user guide is provided. The device may be a hearing aid fitting device or a mobile terminal, such as a smart phone or a tablet computer. Thus, the device may be selected from the group consisting of a mobile terminal and a hearing aid fitting device. A fitting device configured for configuration and provision of a user guide may be advantageous since the size of the user guide is optimized (as small as possible) given a necessary information level requirement, in turn minimizing memory requirements on a mobile terminal to which the user guide is transferred.

The device comprises a communication interface and a processing unit connected to the communication interface. The processing unit may be configured for determining and/or adjusting hearing aid settings and/or hearing aid parameters of a hearing aid. The communication interface may comprise a user interface and/or a device interface. The user interface may comprise a touch screen and/or a display. The communication interface, e.g. the device interface, may comprise a transceiver unit or a plurality of transceiver units selected from the group of a network interface card, a WIFI transceiver, a Bluetooth transceiver, and a Bluetooth low energy transceiver. The communication interface may be configured for transferring hearing aid parameters to the hearing aid.

The device may be a fitting device and/or the user interface may comprise a keyboard and/or a pointer device for setting hearing aid parameters.

The device may, e.g. via the communication interface (device interface), be configured for communicating with a hearing aid. For example, the device may be configured for establishing a hearing aid communication link to a hearing aid via the communication interface. The hearing aid communication link may be a Bluetooth link or a Bluetooth low energy link, or a link in accordance with a specific hearing aid communication protocol or other protocols enabling communication between the device and a hearing aid. Accordingly, the hearing aid communication link may be selected from the group consisting of a Bluetooth link and a Bluetooth low energy link.

The processing unit is configured for obtaining at least one hearing aid setting, e.g. including a first hearing aid setting, of a hearing aid via the communication interface.

The processing unit is configured for configuring a user guide based on the at least one hearing aid setting. The at least one hearing aid setting may comprise a first hearing aid setting, e.g. indicative of hearing aid model.

The at least one hearing aid setting may comprise one or more mode indicators including a first mode indicator indicative of whether a first mode of the hearing aid is enabled or disabled. A mode indicator may be indicative of mode characteristics. The one or more mode indicators may include a second mode indicator indicative of whether a second mode of the hearing aid is enabled or disabled. A mode of the hearing aid may be indicative of a functionality of a program of the hearing aid. For example a mode may be a telecoil mode where a telecoil is included in the hearing device and the hearing device is configured for receiving telecoil signals. Exemplary and non-limiting modes include DAI (Direct Audio Input) mode, wireless communication mode, and NFC (Near Field Communication) mode. Further a mode may be indicative of the specific signal processing performed in the hearing aid in different environments or situations, such as cocktail party processing, omni-directional processing, directional processing, one-to-one speaking processing or others.

In the device and/or method, the at least one hearing aid setting may comprise one or more accessory device indicators including a first accessory device indicator indicative of whether a first accessory device is enabled or disabled. The accessory device indicator may be indicative of accessory device characteristics, such as type, model, communication protocol. An accessory device may be a mobile terminal, a spouse microphone, audio transmitting unit or other accessory devices available to the user of the hearing aid.

In the device and/or method, the at least one hearing aid setting may comprise a user interface indicator indicative of functionality of a hearing aid user interface of the hearing aid. The user interface indicator may be indicative of hearing aid user interface characteristics, such as type and/or functionality or the user interface. This may be advantageous, for example when a push button can be set to different functionalities depending of the fitting, thus avoiding misinforming the user and reducing the risk of unintended use of the hearing aid.

In the device and/or method, the least one hearing aid setting may comprise battery information, such as type and/or size. In the device and/or method, configuring a user guide based on at least one hearing aid setting may comprise adapting a battery part of the user guide based on the battery information.

In the device and/or method, configuring a user guide based on the at least one hearing aid setting may comprise including a picture of a first hearing aid if the first hearing aid setting is indicative of a first hearing aid model and including a picture of a second hearing aid if the first hearing aid setting is indicative of a second hearing aid model, e.g. different from the first hearing aid model.

In the device and/or method, configuring a user guide based on the at least one hearing aid setting may comprise including a first mode part in the user guide if the first mode indicator indicates that the first mode is enabled. The first mode part may comprise information on the first mode, e.g. explain how to use the first mode.

In the device and/or method, configuring a user guide based on the at least one hearing aid setting may comprise excluding a first mode part of a basic user guide if the first mode indicator indicates that the first mode is disabled.

In the device and/or method, configuring a user guide based on the at least one hearing aid setting may comprise including a first accessory part in the user guide if the first accessory device indicator indicates that the first accessory device is enabled In the device and/or method, configuring a user guide based on the at least one hearing aid setting may comprise excluding a first accessory part of a basic user guide if the first accessory device indicator indicates that the first accessory device is disabled.

Exclusion of different parts of a user guide may be advantageous if a user guide is to be updated or a basic user guide with all content is used, e.g. at an initial user guide configuration. In an update situation, the basic user guide may be the current user guide.

In the device and/or method, configuring a user guide based on the hearing aid parameters may comprise including a first description of a first functionality if the user interface indicator is indicative of a first functionality of the hearing aid user interface and including a second description of a second functionality if the user interface indicator is indicative of a second functionality of the hearing aid user interface. The first functionality may be different from the second functionality.

The processing unit is configured for providing the user guide. The device may be a fitting device and providing the user guide may comprise transmitting the user guide to a mobile terminal or a server via the communication interface.

The device may be a mobile terminal and providing the user guide may comprise storing the user guide in memory of the device. The device being a mobile terminal, the device (mobile terminal) may be configured for presenting the user guide on a display of the mobile terminal, e.g. upon user request.

The device may be a mobile terminal, and obtaining the at least one hearing aid setting may comprise obtaining the at least one hearing aid setting from a hearing aid and/or a server via the communication interface. Configuring the user guide based on the at least one hearing aid setting may comprise the device (mobile terminal) requesting a user guide, such as a basic user guide, and/or parts of a user guide from a server. Alternatively or in combination, the device (mobile terminal) may have downloaded user guide parts and/or a basic user guide from the server prior to configuring the user guide.

The device may be a server, such as a web server and/or a database server, and providing the user guide may comprise transmitting the user guide to a mobile terminal and/or a fitting device via the communication interface.

The user guide may comprise or be a combination of one or more of text, pictures and video clips. The user guide may be a single file, or a collection of separate files. The user guide may be a collection of hyperlinks to content on a server.

The processing unit may be configured for reconfiguring the user guide, e.g. at a certain frequency, upon user request, and/or upon an update request, e.g. from a manufacturer of the hearing aid or hearing aid dispenser.

The method may comprise reconfiguring the user guide, e.g. at a certain frequency, upon user request, and/or upon an update request, e.g. from a manufacturer of the hearing aid or hearing aid dispenser. Reconfiguring the user guide may comprise obtaining updated parts of the user guide.

FIG. 1 schematically illustrates an exemplary device 2 for providing a hearing aid user guide 12. The device 2 may be a mobile terminal, a hearing aid fitting device, or a server, e.g. a web server and/or a database server.

The device 2 comprises a communication interface 4, 4', 4", and a processing unit 6 connected to the communication interface 4, 4', 4". The processing unit is configured for obtaining hearing aid settings 10, such as at least one hearing aid setting 10, via the communication interface 4, 4', 4". The processing unit 6 is further configured for configuring and providing a user guide 12 based on the at least one hearing aid setting 10. The user guide 12 may provide a user with information of the hearing aid, such as in text, graphical representations, pictures, and/or movie clips.

The at least one hearing aid setting 10 may comprise a first hearing aid setting, e.g. indicative of hearing aid model. Thus, configuring the user guide 12 may comprise including picture(s) corresponding to the hearing aid model indicated by the first hearing aid setting. Thus, configuring the user guide 12 may comprise including a picture of a first hearing aid if the first hearing aid setting is indicative of the first hearing aid, and/or configuring the user guide 12 may comprise including a picture of a second hearing aid if the first hearing aid setting is indicative of the second hearing aid.

The at least one hearing aid setting 10 may comprise a first mode indicator, e.g. indicative of whether a first mode of the hearing aid is enabled or disabled. Thus, configuring the user guide 12 may comprise adapting the user guide according to the first mode indicator. Thus, configuring the user guide 12 may comprise including a first mode part in the user guide if the first mode indicator is indicative of the first mode being enabled, and/or configuring the user guide 12 may comprise excluding a first mode part in the user guide, e.g. excluding from a basic user guide, if the first mode indicator is indicative of the first mode being disabled.

The at least one hearing aid setting 10 may comprise a first accessory device indicator, e.g. indicative of whether a first accessory device is enabled or disabled. Thus, configuring the user guide 12 may comprise adapting the user guide 12 according to the first accessory device indicator. Thus, configuring the user guide 12 may comprise including a first accessory part in the user guide if the first accessory device indicator is indicative of the first accessory device being enabled, and/or configuring the user guide 12 may comprise excluding a first accessory part in the user guide, e.g. excluding from a basic user guide, if the first accessory device indicator is indicative of the first accessory device being disabled.

The at least one hearing aid setting 10 may comprise a user interface indicator, e.g. indicative of functionality of a hearing aid user interface. Thus, configuring the user guide 12 may comprise adapting the user guide 12 according to the user interface indicator. Thus, configuring the user guide 12 may comprise including a first description of a first functionality in the user guide if the user interface indicator is indicative of a first functionality of the hearing aid user interface, and/or configuring the user guide 12 may comprise including a second description of a second functionality in the user guide if the user interface indicator is indicative of a second functionality of the hearing aid user interface.

The at least one hearing aid setting 10 may comprise battery information, e.g. type and/or model number of a battery. Thus, configuring the user guide 12 may comprise adapting the user guide 12 according to the battery information. Thus configuring the user guide 12 may comprise adapting a battery part of the user guide 12 and/or a basic user guide based on the battery information.

Figure 2:
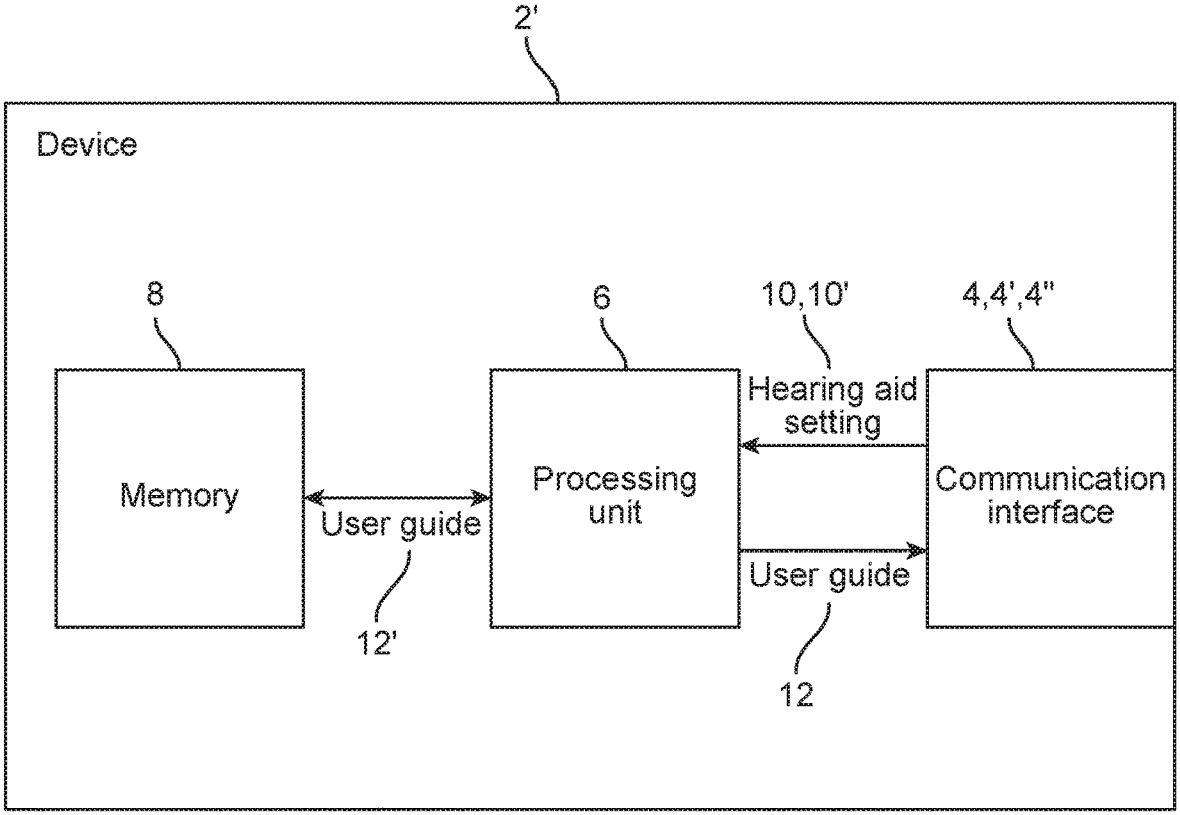
FIG. 2 schematically illustrates an exemplary device.

FIG. 2 schematically illustrates an exemplary device 2' for providing a hearing aid user guide 12, 12'. The device 2' may be a mobile terminal, a hearing aid fitting device, or a server, e.g. a web server and/or a database server.

The device 2' comprises a communication interface 4, 4', 4", and a processing unit 6 connected to the communication interface 4, 4', 4". The processing unit is configured for obtaining hearing aid settings 10, such as at least one hearing aid setting 10, via the communication interface 4, 4', 4". The processing unit 6 is further configured for configuring and providing a user guide 12, 12' based on the at least one hearing aid setting 10.

Furthermore, the device 2' comprises memory 8. The processing unit 6 is configured for providing the user guide 12' to the memory 8 and/or providing the user guide 12 to the communication unit 4, 4', 4".

Figure 3:
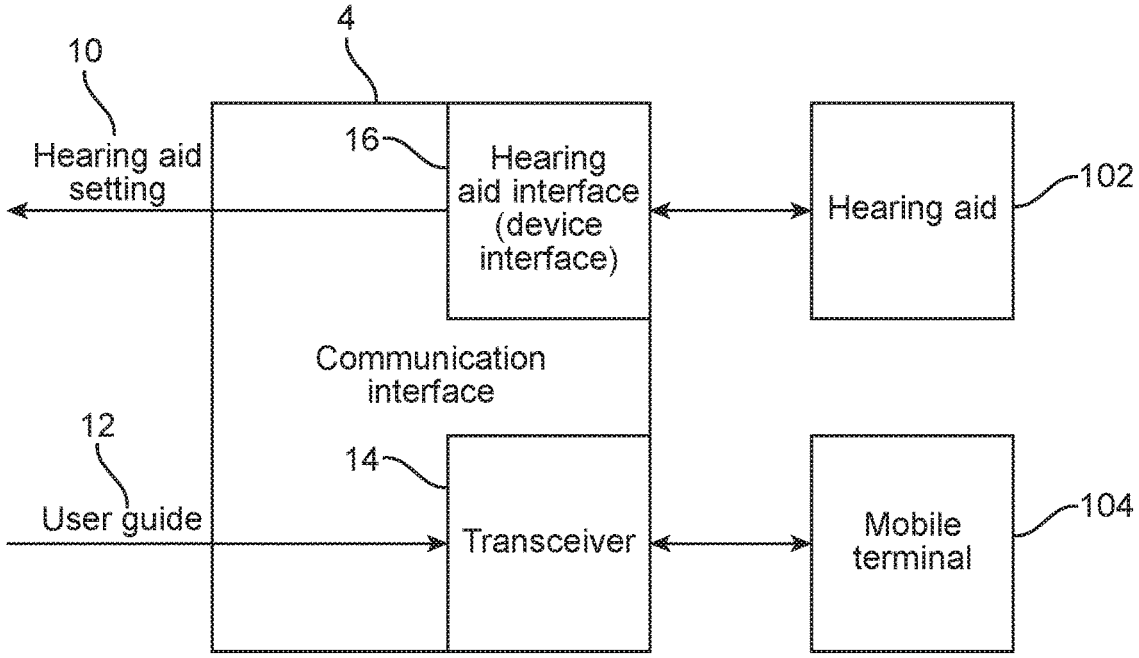
FIG. 3 schematically illustrates an exemplary communication interface.

FIG. 3 schematically illustrates an exemplary communication interface 4, such as the communication interface 4 of the device 2 (FIG. 1) and/or of the device 2' (FIG. 2).

The communication interface 4 comprises a transceiver 14 which may communicate with a mobile terminal 104, such as a smart phone, a tablet computer, and/or a laptop. For example, the transceiver 14 may comprise a Bluetooth transceiver, a Wi-Fi transceiver, a USB port, an internet connection, and/or a local area network connection.

The communication interface 4 comprises a hearing aid interface 16 which may communicate with a hearing aid 102. The hearing aid interface 16 may provide a link with the hearing aid in accordance with a specific hearing aid communication protocol or other protocols enabling communication between the device and a hearing aid. For example, the hearing aid interface may comprise a Bluetooth transceiver, a Bluetooth low energy transceiver, a Wi-Fi transceiver, a USB port, an NFC transceiver.

In an alternative communication interface (not shown), the transceiver 14 and the hearing aid interface 16 may be the same interface, i.e. the hearing aid 102 and the mobile terminal 104 may communicate with the communication interface using the same unit, e.g. a wireless transceiver.

The communication interface 4 may provide the at least one hearing aid setting 10 by obtaining the hearing aid setting from the hearing aid 102 via the hearing aid interface 16.

The communication interface 4 may provide the user guide 12 to the mobile terminal 104 via the transceiver 14.

Figure 4:
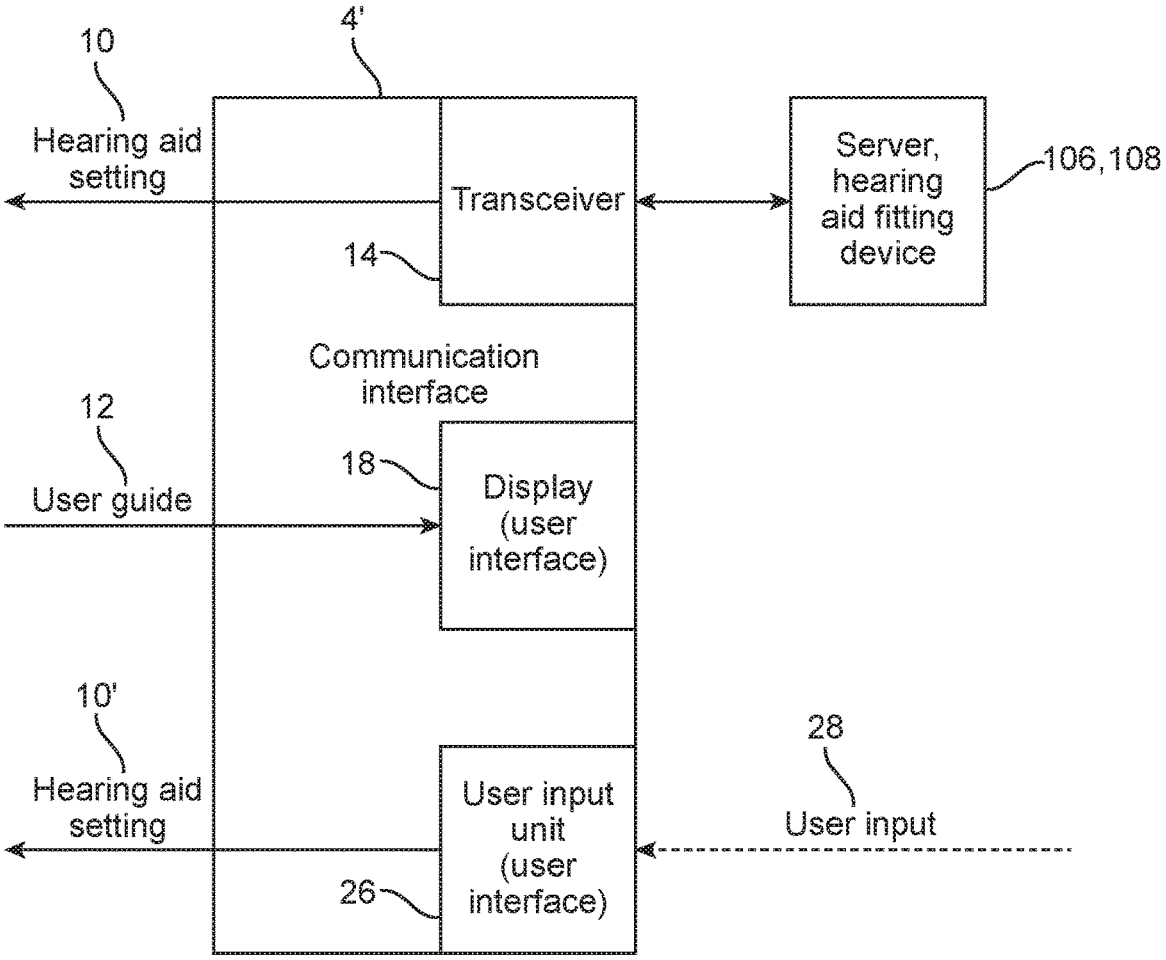
FIG. 4 schematically illustrates an exemplary communication interface.

FIG. 4 schematically illustrates an exemplary communication interface 4', such as the communication interface 4' of the device 2 (FIG. 1) and/or of the device 2' (FIG. 2).

The communication interface 4' comprises a transceiver 14. The transceiver 14 may be configured to communicate with a server 106, such as a web server and/or a database server, and/or the transceiver 14 may be configured to communicate with a hearing aid fitting device 108. For example, the transceiver 14 may comprise a Bluetooth transceiver, a Wi-Fi transceiver, a USB port, an internet connection, and/or a local area network connection.

The communication interface 4' comprises user interface units, such as a display 18, and a user input unit 26. The communication interface 4' may be configured for presenting the user guide 12 to a user via the display 18.

The communication interface 4' may receive the at least one hearing aid setting 10 from the server 106 and/or the hearing aid fitting device 108 via the transceiver 14. Alternatively or additionally, the communication interface 4' may receive at least one hearing aid setting 10' from a user input 28 via the user input unit 26.

The display 18 and the user input unit 26 may be combined, e.g. the communication interface 4' may comprise a touch display, wherein the touch display comprises the display 8 and the user input unit 26.

Figure 5:
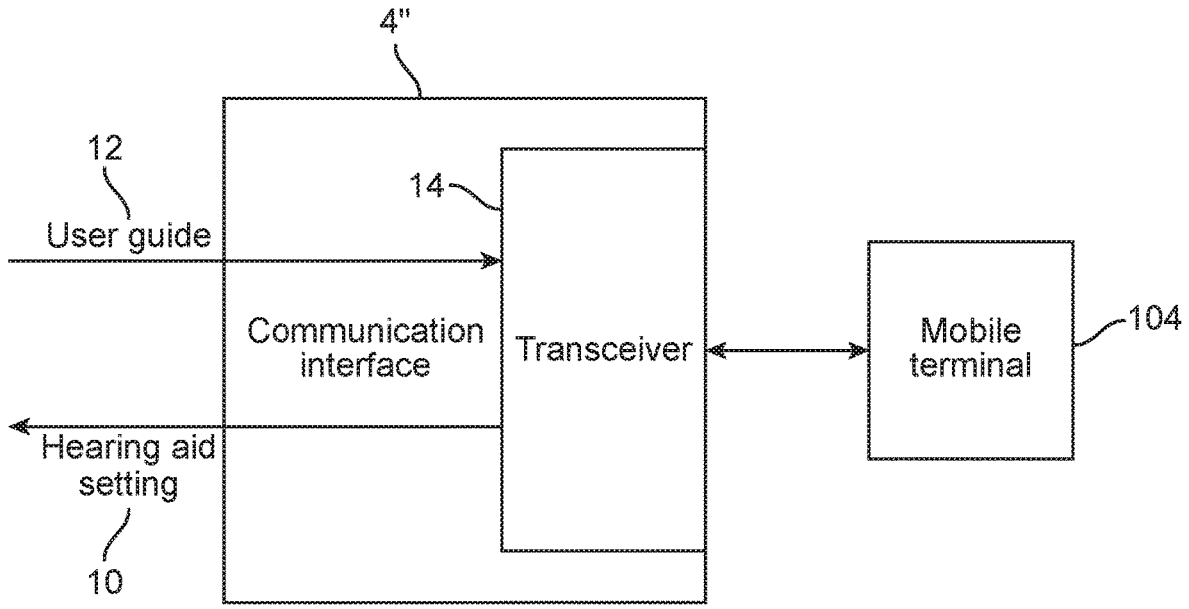
FIG. 5 schematically illustrates an exemplary communication interface.

FIG. 5 schematically illustrates an exemplary communication interface 4", such as the communication interface 4" of the device 2 (FIG. 1) and/or of the device 2' (FIG. 2).

The communication interface 4" comprises a transceiver 14. The transceiver 14 may be configured to communicate with a mobile terminal 104, such as a smart phone, a tablet computer, and/or a laptop. For example, the transceiver 14 may comprise a Bluetooth transceiver, a Wi-Fi transceiver, a USB port, an internet connection, and/or a local area network connection.

The communication interface 4" receives the at least one hearing aid setting 10 from the mobile terminal 104 via the transceiver 14. The communication interface may provide the user guide 12 to the mobile terminal 104 via the transceiver 14.

For example, the communication interface 4" may be a communication interface 4" of a device, wherein the device is a server, such as a web server and/or a database server. Thus, the processing unit of the device may be configured to obtain at least one hearing aid setting via the transceiver 14 of the communication device 4". The processing unit is further configured to configure the user guide 12 based on the at least one hearing aid setting 10. Furthermore, the processing unit is configured to provide the user guide 12 to the mobile terminal 104 via the transceiver 14 of the communication device 4".

Figure 6:
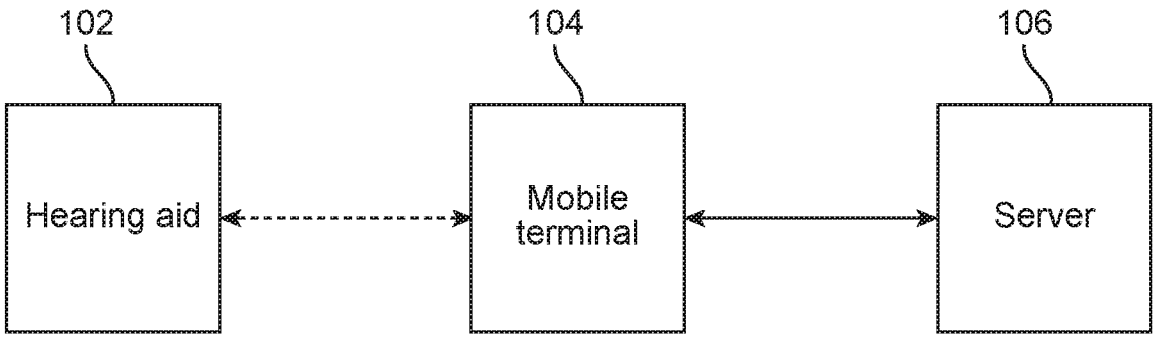
FIG. 6 is a diagram of exemplary communication.

FIG. 6 is a diagram of exemplary communication between a mobile terminal 104 and a server 106, and optionally a hearing aid 102.

The mobile terminal 104 may be a smart phone, a tablet computer, and/or a laptop.

The server 106 may be a web server and/or a database server.

The server 106 obtains the at least one hearing aid setting from the mobile terminal 104, and the server configures the user guide based on the at least one hearing aid setting, and the server provides the user guide to the mobile terminal 104. The mobile terminal may obtain the at least one hearing aid setting from user input, or alternatively or additionally, the mobile terminal may obtain the at least one hearing aid setting from the hearing aid 102, e.g. via Bluetooth transmission or NFC transmission or the at least one hearing aid setting.

Alternatively, the mobile terminal 104 obtains the at least one hearing aid setting, either from the hearing aid 102, e.g. via Bluetooth transmission or NFC transmission of the at least one hearing aid setting, or from user input (not shown) via user interface. The mobile terminal 104 configures the user guide based on the at least one hearing aid setting, and the mobile terminal provides the user guide, e.g. to memory of the mobile terminal 104 and/or to a display of the mobile terminal 104. In configuring the user guide, the mobile terminal 104 may request a user guide, such as a basic user guide, and/or parts of a user guide from the server 106. Alternatively, the mobile terminal 104 may have downloaded user guide parts and/or a basic user guide from the server 106 prior to configuring the user guide.

Figure 7:
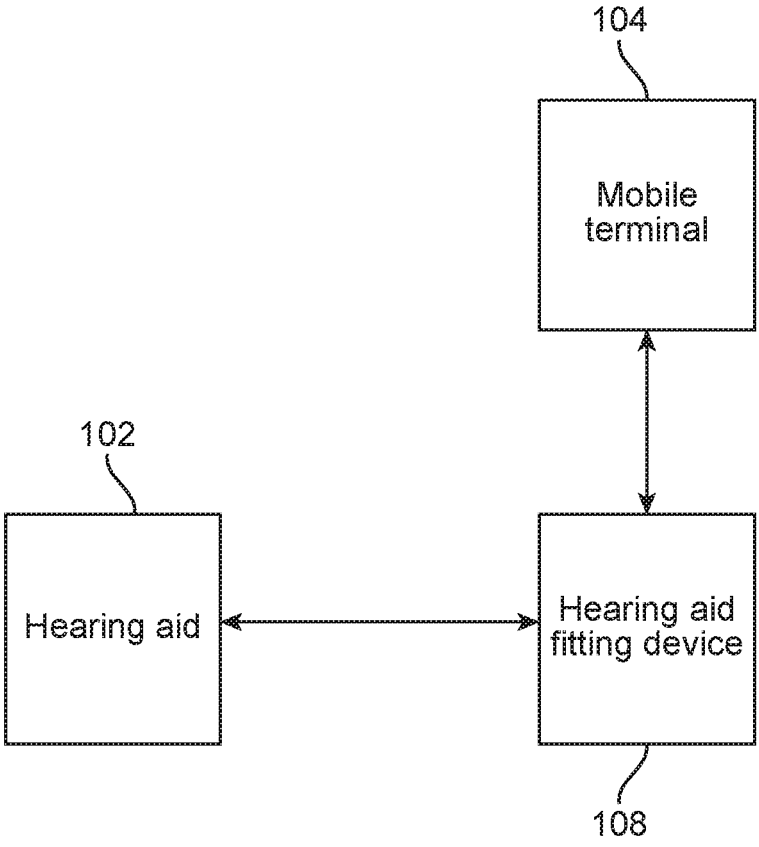
FIG. 7 is a diagram of exemplary communication.

FIG. 7 is a diagram of exemplary communication between a mobile terminal 104, a hearing aid 102, and a hearing aid fitting device 108.

The hearing aid fitting device 108 obtain the at least one hearing aid setting from the hearing aid 102 and/or from user input (not shown). The hearing aid fitting device 108 configures the user guide based on the at least one hearing aid setting, and the hearing aid fitting device 108 provides the user guide to the mobile terminal 104.

Figure 8:
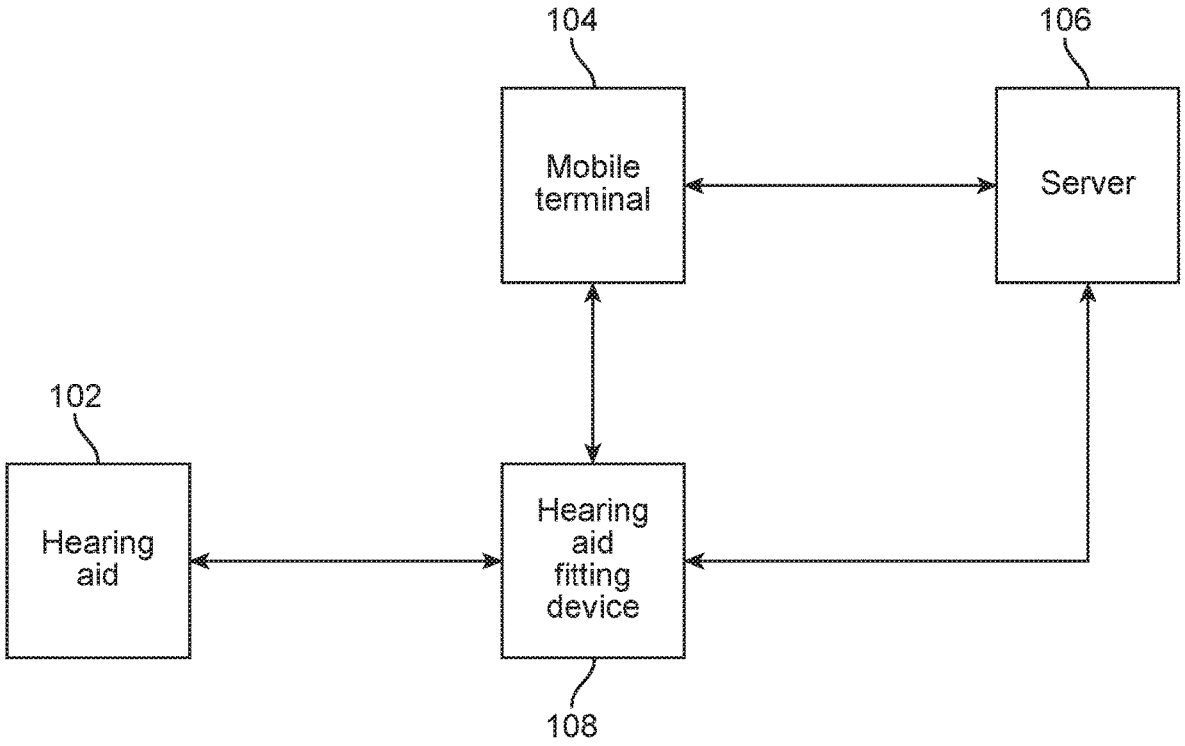
FIG. 8 is a diagram of exemplary communication.

FIG. 8 is a diagram of exemplary communication between a hearing aid 102, a mobile terminal 104, a server 106, and a hearing aid fitting device 108.

The hearing aid 102 may communicate with the hearing aid fitting device 108. For example, the hearing aid fitting 108 device may obtain the at least one hearing aid setting from the hearing aid 102. The hearing aid fitting device 108 may configure a user guide based on the at least one hearing aid settings. The hearing aid fitting device 108 may provide the user guide to the mobile terminal 104.

The mobile terminal 104 may communicate with the hearing aid fitting device 108 and/or the server 106. For example, the mobile terminal 104 may receive the user guide from the hearing aid fitting device 108. Alternatively, the mobile terminal 104 may obtain the at least one hearing aid setting from the hearing aid fitting device 108, and the mobile terminal 104 may configure a user guide based on the at least one hearing aid settings. The mobile terminal may provide the user guide to memory of the mobile terminal 104 and/or to a display of the mobile terminal 104. The mobile terminal 104 may request a user guide, such as a basic user guide, and/or parts of a user guide from the server 106.

The server 106 may communicate with the hearing aid fitting device 108 and/or the mobile terminal 104. For example, the server 106 may obtain the at least one hearing aid setting from the hearing aid fitting device 108. Alternatively, the server 106 may obtain the at least one hearing aid setting from the mobile terminal 104. The server 106 may configure a user guide based on the at least one hearing aid settings. The server 106 may provide the user guide to the mobile terminal 104.

Figure 9:
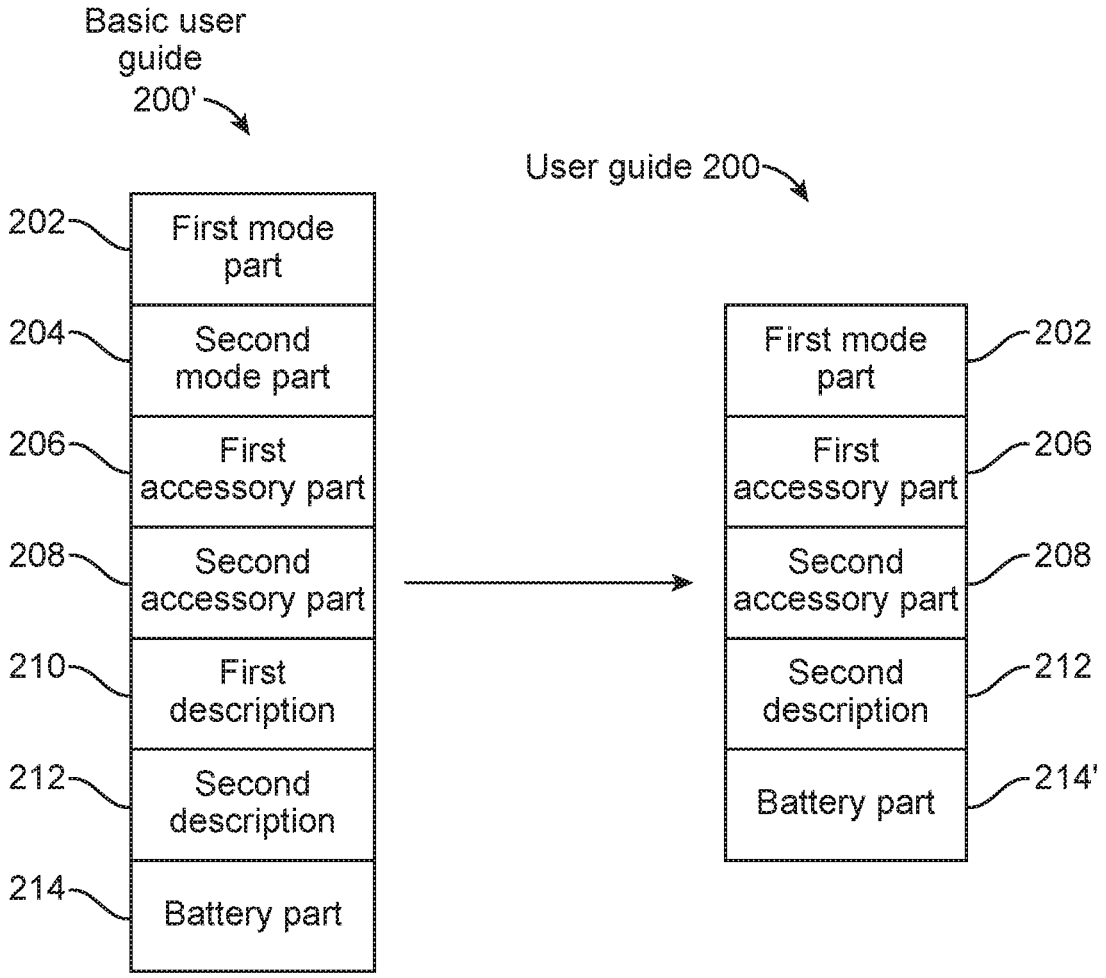
FIG. 9 is a diagram of configuration of an exemplary user guide

FIG. 9 is a diagram of configuration of an exemplary user guide 200, wherein a basic user guide 200' is provided. The basic user guide 200' comprises a plurality of user guide parts including a first mode part 202, a second mode part 204, a first accessory part 206, a second accessory part 208, a first description 210, a second description 212, and a battery part 214.

In configuring the user guide 200, the second mode part 204 and the first description 210 are excluded from the basic user guide 200' based on the at least one hearing aid setting, and the battery part 214 is adapted to battery part 214' based on battery information of the at least one hearing aid setting. Thus, the user guide 200 comprises the first mode part 202, the first accessory part 206, the second accessory part 208, the second description 212, and the adapted battery part 214'.

The plurality of user guide parts may be hyperlinks to content on a server.

Figure 10:
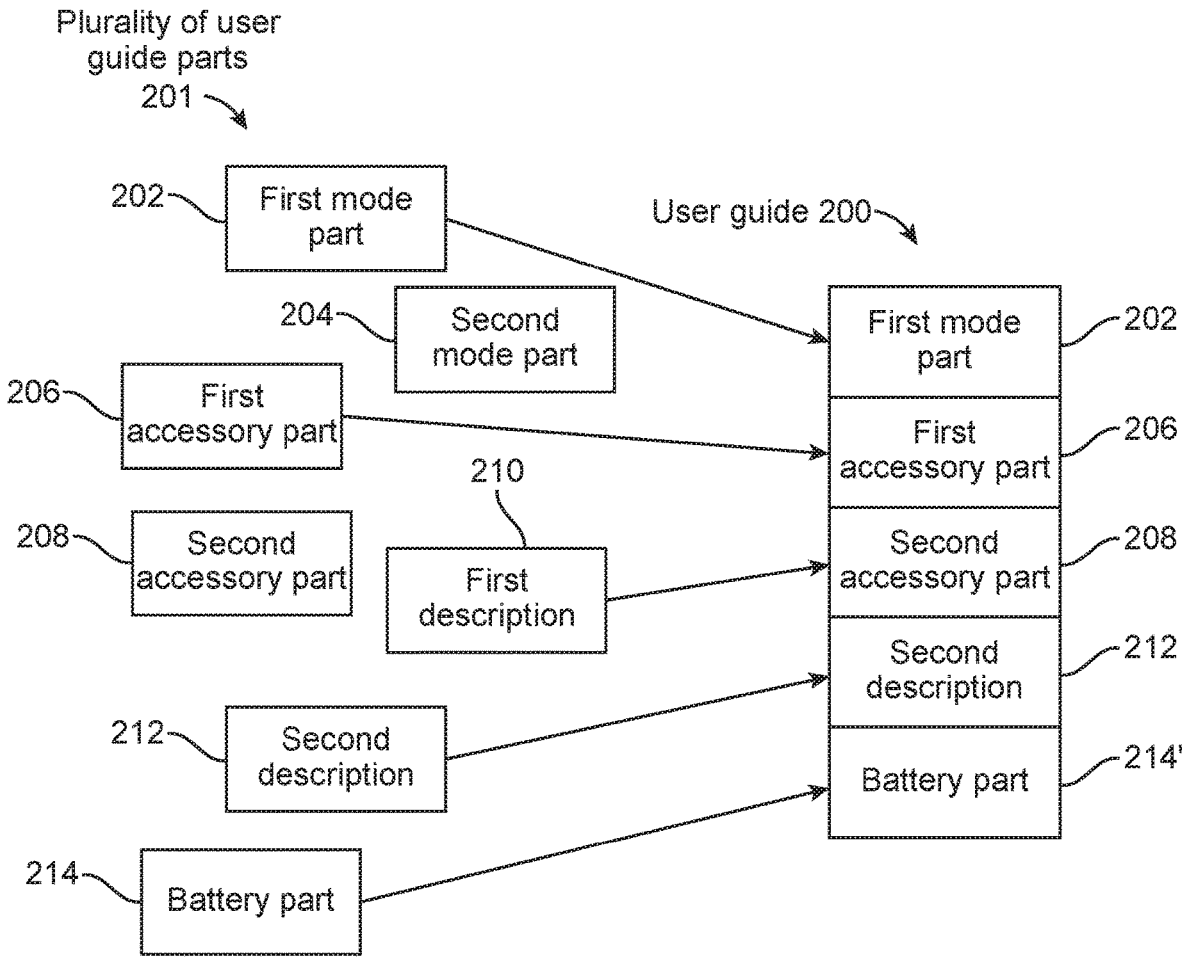
FIG. 10 is a diagram of configuration of an exemplary user guide.

FIG. 10 is a diagram of configuration of an exemplary user guide 200, wherein a plurality of user guide parts 201 is provided. The plurality of user guide parts 201 comprises a first mode part 202, a second mode part 204, a first accessory part 206, a second accessory part 208, a first description 210, a second description 212, and a battery part 214.

In configuring the user guide 200, the first mode part 202, the first accessory part 206, the second accessory part 208, and the second description 212 are included in the user guide based on the at least one hearing aid setting. The battery part 214 is adapted and included 214' according to battery information of the at least one hearing aid setting. Thus, the user guide 200 comprises the first mode part 202, the first accessory part 206, the second accessory part 208, the second description 212, and the adapted battery part 214'.

The plurality of user guide parts 201 may be hyperlinks to content on a server.

The user guide 200 may be the user guide 12 or 12' described in relation to previous figures.

Figure 11:
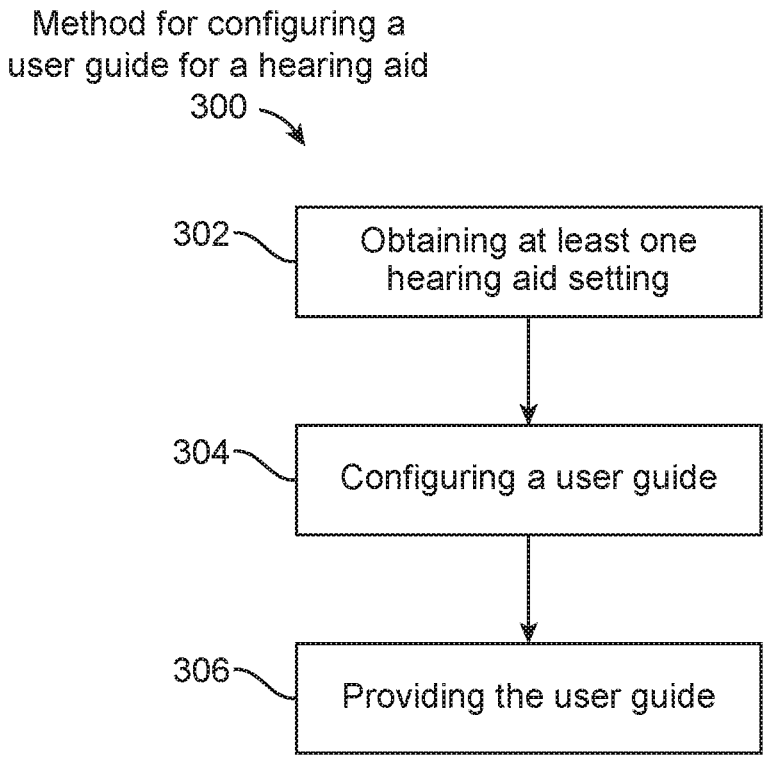
FIG. 11 is a flow diagram of an exemplary method.

FIG. 11 is a flow diagram of an exemplary method 300 for configuring a user guide for a hearing aid, e.g. with a device comprising a communication interface and a processing unit connected to the communication interface. The method 300 comprises obtaining 302 at least one hearing aid setting, e.g. from a hearing aid dispenser and/or a hearing aid user via a user interface and/or from a hearing aid connected to the device. Further, the method 300 comprises configuring 304 a user guide based on the at least one hearing aid setting, and the method then proceeds to providing 306 the user guide, e.g. to a mobile terminal.

The obtained 302 at least one hearing aid setting may comprise a first hearing aid setting, e.g. indicative of hearing aid model. Thus, configuring 304 the user guide may comprise including picture(s) corresponding to the hearing aid model indicated by the first hearing aid setting. Thus, configuring 304 the user guide may comprise including a picture of a first hearing aid if the first hearing aid setting is indicative of the first hearing aid, and/or configuring 304 the user guide may comprise including a picture of a second hearing aid if the first hearing aid setting is indicative of the second hearing aid.

The obtained 302 at least one hearing aid setting may comprise a first mode indicator, e.g. indicative of whether a first mode of the hearing aid is enabled or disabled. Thus, configuring 304 the user guide may comprise adapting the user guide according to the first mode indicator. Thus, configuring 304 the user guide may comprise including a first mode part in the user guide if the first mode indicator is indicative of the first mode being enabled, and/or configuring 304 the user guide may comprise excluding a first mode part in the user guide, e.g. excluding from a basic user guide, if the first mode indicator is indicative of the first mode being disabled.

The obtained 302 at least one hearing aid setting may comprise a first accessory device indicator, e.g. indicative of whether a first accessory device is enabled or disabled. Thus, configuring 304 the user guide may comprise adapting the user guide according to the first accessory device indicator.

Thus, configuring 304 the user guide may comprise including a first accessory part in the user guide if the first accessory device indicator is indicative of the first accessory device being enabled, and/or configuring 304 the user guide may comprise excluding a first accessory part in the user guide, e.g. excluding from a basic user guide, if the first accessory device indicator is indicative of the first accessory device being disabled.

The obtained 302 at least one hearing aid setting may comprise a user interface indicator, e.g. indicative of functionality of a hearing aid user interface. Thus, configuring 304 the user guide may comprise adapting the user guide according to the user interface indicator. Thus, configuring 304 the user guide may comprise including a first description of a first functionality in the user guide if the user interface indicator is indicative of a first functionality of the hearing aid user interface, and/or configuring 304 the user guide may comprise including a second description of a second functionality in the user guide if the user interface indicator is indicative of a second functionality of the hearing aid user interface.

The obtained 302 at least one hearing aid setting may comprise battery information, e.g. type and/or model number of a battery. Thus, configuring 304 the user guide may comprise adapting the user guide according to the battery information. Thus configuring 304 the user guide may comprise adapting a battery part of the user guide and/or a basic user guide based on the battery information.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

| | |
|---|---|
| 2, 2' | device |
| 4, 4', 4" | communication interface |
| 6 | processing unit |
| 8 | memory |
| 10, 10' | hearing aid setting |
| 12, 12' | user guide |
| 14 | transceiver |
| 16 | hearing aid interface (device interface) |
| 18 | display (user interface) |
| 26 | user input unit (user interface) |
| 28 | user input |
| 102 | hearing aid |
| 104 | mobile terminal |
| 106 | server |
| 108 | hearing aid fitting device |
| 200 | user guide |
| 200' | basic user guide |
| 201 | plurality of user guide parts |
| 202 | first mode part |
| 204 | second mode part |
| 206 | first accessory part |
| 208 | second accessory part |
| 210 | first description |
| 212 | second description |
| 214, 214' | battery part |
| 300 | Method for configuring a user guide for a hearing aid |
| 302 | obtaining at least one hearing aid setting |
| 304 | configuring a user guide |
| 306 | providing the user guide. |

The invention claimed is:

1. A device for providing a hearing aid user guide for a hearing aid, comprising:

a communication interface configured to communicate with the hearing aid; and a processing unit connected to the communication interface, wherein the processing unit comprises at least some hardware, and wherein the processing unit is configured for:

obtaining at least one hearing aid setting of the hearing aid from the hearing aid via the communication interface; and configuring a user guide based on the at least one hearing aid setting obtained from the hearing aid;

wherein the device is configured to provide the user guide for the hearing aid;

wherein the at least one hearing aid setting comprises one or more mode indicators including a first mode indicator indicative of whether a first mode of the hearing aid is enabled or disabled, the first mode being a sound signal processing functionality of the hearing aid; and wherein the processing unit of the device comprises logic that associates a state of the first mode indicator with user guide information for the user guide.

2. The device according to claim 1, wherein the device is selected from the group consisting of a mobile terminal and a hearing aid fitting device.

3. The device according to claim 1, wherein the communication interface comprises a network interface card, a WIFI transceiver, a Bluetooth transceiver, or a Bluetooth low energy transceiver.

4. The device according to claim 1, wherein the device is a hearing aid fitting device, and wherein the processing unit is configured to provide the user guide by transmitting the user guide to a mobile terminal via the communication interface.

5. The device according to claim 1, wherein the device is a mobile terminal, the communication interface comprises a display, and the mobile terminal is configured for presenting the user guide on the display.

6. The device according to claim 1, wherein the processing unit is configured to include a user guide part for the first mode in the user guide if the first mode indicator indicates that the first mode is enabled, to thereby configure the user guide.

7. The device according to claim 1, wherein the processing unit is configured to exclude a user guide part for the first mode from the user guide if the first mode indicator indicates that the first mode is disabled, to thereby configure the user guide.

8. The device according to claim 1, wherein the at least one hearing aid setting comprises battery information, and wherein the processing unit is configured to configured the user guide based on the battery information.

9. The device of claim 1, wherein the processing unit is configured to provide the user guide for display after the processing unit has configured the user guide.

10. The device of claim 1, wherein the processing unit is configured to electronically configuring the user guide.

11. A device for providing a hearing aid user guide for a hearing aid, comprising:

a communication interface configured to communicate with the hearing aid; and a processing unit connected to the communication interface, wherein the processing unit comprises at least some hardware, and wherein the processing unit is configured for:

obtaining at least one hearing aid setting of the hearing aid from the hearing aid via the communication interface; and configuring a user guide based on the at least one hearing aid setting obtained from the hearing aid;

wherein the device is configured to provide the user guide for the hearing aid;

wherein the at least one hearing aid setting comprises a first hearing aid setting indicative of a product model; and wherein the processing unit of the device comprises logic that associates the product model with user guide information for the user guide.

12. A device for providing a hearing aid user guide for a hearing aid, comprising:

a communication interface configured to communicate with the hearing aid; and a processing unit connected to the communication interface, wherein the processing unit comprises at least some hardware, and wherein the processing unit is configured for:

obtaining at least one hearing aid setting of the hearing aid from the hearing aid via the communication interface; and configuring a user guide based on the at least one hearing aid setting obtained from the hearing aid;

wherein the device is configured to provide the user guide for the hearing aid;

wherein the at least one hearing aid setting comprises a first hearing aid setting indicative of a hearing aid model;

wherein the processing unit is configured to include a picture of a first hearing aid in the user guide if the first hearing aid setting is indicative of a first hearing aid model, and to include a picture of a second hearing aid in the user guide if the first hearing aid setting is indicative of a second hearing aid model, to thereby configure the user guide; and wherein the processing unit of the device comprises logic that associates the first hearing aid model with user guide information for the user guide.

13. A device for providing a hearing aid user guide for a hearing aid, comprising:

a communication interface configured to communicate with the hearing aid; and a processing unit connected to the communication interface, wherein the processing unit comprises at least some hardware, and wherein the processing unit is configured for:

obtaining at least one setting from the hearing aid via the communication interface; and configuring a user guide based on the at least one setting obtained from the hearing aid;

wherein the device is configured to provide the user guide for the hearing aid;

wherein the at least one setting comprises a first accessory device indicator indicative of whether a first accessory device is enabled or disabled, and wherein the user guide for the hearing aid is configured based on the first accessory device indicator; and wherein the processing unit of the device comprises logic that associates a state of the first accessory device indicator with user guide information for the user guide.

14. The device according to claim 13, wherein the processing unit is configured to include a user guide part for the first accessory device in the user guide if the first accessory device indicator indicates that the first accessory device is enabled.

15. The device according to claim 13, wherein the processing unit is configured to exclude a user guide part for the first accessory device from the user guide if the first accessory device indicator indicates that the first accessory device is disabled.

16. A device for providing a hearing aid user guide for a hearing aid, comprising:

a communication interface configured to communicate with the hearing aid; and a processing unit connected to the communication interface, wherein the processing unit comprises at least some hardware, and wherein the processing unit is configured for:

obtaining at least one hearing aid setting of the hearing aid from the hearing aid via the communication interface; and configuring a user guide based on the at least one hearing aid setting obtained from the hearing aid;

wherein the device is configured to provide the user guide for the hearing aid;

wherein the at least one hearing aid setting comprises a user interface indicator indicative of a functionality of a hearing aid button of the hearing aid; and wherein the processing unit is configured to include a first description of a first functionality in the user guide if the user interface indicator is indicative of a first functionality of the hearing aid button, and to include a second description of a second functionality in the user guide if the user interface indicator is indicative of a second functionality of the hearing aid button, to thereby configure the user guide; and wherein the processing unit of the device comprises logic that associates an indication of the user interface indicator with user guide information for the user guide.

17. A method for configuring a user guide for a hearing aid, the method comprising:

obtaining at least one hearing aid setting by a device via a communication interface, wherein the communication interface is configured to communicate with the hearing aid;

configuring a user guide by a processing unit of the device based on the at least one hearing aid setting obtained from the hearing aid, wherein the processing unit comprises at least some hardware; and providing, by the device, the user guide for the hearing aid;

wherein the at least one hearing aid setting comprises one or more mode indicators including a first mode indicator indicative of whether a first mode of the hearing aid is enabled or disabled, the first mode being a sound signal processing functionality of the hearing aid; and wherein the processing unit of the device comprises logic that associates a state of the first mode indicator with user guide information for the user guide.

* * * * *